US005373784A

United States Patent [19]

Muraji

[11] Patent Number: 5,373,784

[45] Date of Patent: Dec. 20, 1994

[54] TYPE-WHEEL RESETTING MECHANISM FOR PRINTER

[75] Inventor: Atsushi Muraji, Fujisawa, Japan

[73] Assignee: Minebea Kabushiki-Kaisha (Minebea Co. Ltd.), Nagano, Japan

[21] Appl. No.: 168,370

[22] Filed: Dec. 17, 1993

[30] Foreign Application Priority Data

Dec. 31, 1992 [JP] Japan ..... 4-362106

[51] Int. Cl.[5] ..... B41J 1/32

[52] U.S. Cl. ..... 101/93.21; 101/110; 101/99; 101/93.29

[58] Field of Search ..... 101/59, 75, 79, 83, 101/85, 93.18, 93.19, 93.2, 93.21, 93.26, 93.28, 99, 106, 110, 93.29

[56] References Cited

U.S. PATENT DOCUMENTS 3,741,112 6/1973 Cayla ..... 101/93.21
4,452,137 6/1984 Takeuchi et al. ..... 101/93.28 X
5,069,123 12/1991 Murata et al. ..... 101/93.21
5,113,759 5/1992 Nihira ..... 101/93.21
5,158,015 10/1992 Harada et al. ..... 101/93.18
5,249,512 10/1993 McChesney ..... 101/99

FOREIGN PATENT DOCUMENTS 0034494 4/1981 Japan ..... 101/93.21

*Primary Examiner*—Edgar S. Burr
*Assistant Examiner*—Christopher A. Bennett
*Attorney, Agent, or Firm*—Fred Philpitt

[57] ABSTRACT

In the type-wheel resetting mechanism for the downsized printer: a resetting cam portion (13) is provided in a drive gear (12) to save the number of components and to eliminate assembly and adjusting operations of the cam portion (13) and the drive gear (12); detected portions (25, 25*a*) for type selection and motor stop operations are provided separately from the drive gear (12); and, a sensor (26) for detecting the detected portions (25, 25*a*) is provided in the vicinity of the drive gear (12) to save the number of components, which simplifies the construction of the type-wheel resetting mechanism and improves the type-wheel resetting mechanism in reliability.

2 Claims, 11 Drawing Sheets

TYPE-WHEEL RESETTING MECHANISM FOR PRINTER

BACKGROUND OF THE INVENTION

1. Field of the Invention

The present invention relates to an improved type-wheel resetting mechanism for a downsized printer.

2. Description of the Prior Art

In a conventional type-wheel resetting mechanism for the downsized printer, a spring mechanism is not employed therein, which makes the resetting mechanism complicated in construction.

Further, in the conventional type-wheel resetting mechanism, since a resetting cam portion and a drive gear thereof are constructed separately from each other, the resetting mechanism requires a large number of components. These components must be assembled with the drive gear, which increases the number of production steps and has the assembly of these components entangled.

Furthermore, in the conventional type-wheel resetting mechanism, a detected portion for type selection and motor stop operations is provided separately from the drive gear and has its detection signal issued from a signal detection panel. However, such position and the panel are difficult in mounting and adjusting in arrangement.

SUMMARY OF THE INVENTION

It is an object of the present invention to provide a type-wheel resetting mechanism for a downsized printer, in which mechanism a leaf spring mechanism is employed to simplify the type-wheel resetting mechanism in construction.

It is another object of the present invention to provide a type-wheel resetting mechanism for a downsized printer, in which mechanism a resetting cam portion is provided in a drive gear to save the number of components and to eliminate the assembly and adjusting operations of a cam and the drive gear.

It is further another object of the present invention to provide a type-wheel resetting mechanism for a downsized printer, in which mechanism: a plurality of detected portions for type selection and motor stop operations are provided separately from the drive gear; and, a sensor for detecting the detected portions is provided in the vicinity of the drive gear to save the number of components, which improves the type-wheel resetting mechanism in reliability.

According to a first aspect of the present invention, the above objects of the present invention are accomplished by providing:

A type-wheel resetting mechanism for a downsized printer, comprising:

(a) a type wheel provided with a plurality of types in its outer peripheral surface, the type wheel being also provided with a ratchet wheel in its side surface, the ratchet wheel being provided with a plurality of ratchet teeth and a resetting tooth which radially outwardly extends slightly larger than any one of the ratchet teeth, the type wheel being rotatably mounted on a type-wheel shaft while rotatably driven together with the type-wheel shaft under the influence of a friction spring;

(b) a drive gear provided with a cam portion in its side surface, the cam portion being constructed of a series of portions comprising a small-diameter portion, an intermediate-diameter, portion and a large-diameter portion adapted to perform a start-up operation, the drive gear so rotating as to have the type wheel driven rotatably two times faster than its rotational speed;

(c) a latch holder provided with a pair of bearing flanges in its opposite ends, to which flanges a latch shaft is loosely fitted, the latch holder being urged by a spring in a direction toward the type wheel, the latch holder being also provided with a guide pin in its one end to have the guide pin engaged with the cam portion of the drive gear;

(d) a latch lever provided with an elongated hole to which the latch shaft is loosely fitted, the latch lever being further provided with a pawl portion in its upper portion to have the pawl portion engaged with and disengaged from the ratchet wheel;

(e) an electromagnet which attracts a leg portion of the latch lever when de-energized, and loses its attractive force when energized;

(f) a leaf spring integrally formed with a notch portion of a spring plate mounted on the latch holder;

(g) a plurality of detected portions provided in the drive gear, the detected portions being adapted for type selection and motor stop operations, through which type selection operation the types of the type wheel corresponding to the ratchet teeth of the same are detected; and (h) a sensor for detecting the detected portions to issue signals to a control circuit so as to have the control circuit issue a printing instruction and a motor stopping instruction.

Further, according to a second aspect of the present invention, the above objects of the present invention are accomplished by providing:

The type-wheel resetting mechanism for the downsized printer, as set forth in the first aspect of the present invention, wherein:

each of the detected portions of the drive gear is constructed of a through-hole formed in a position on the same coaxial circle of the drive gear; and the sensor is constructed of a photo-coupler for detecting a light beam passing through the through-hole of the drive gear.

DESCRIPTION OF THE PREFERRED EMBODIMENTS

Figure 1:
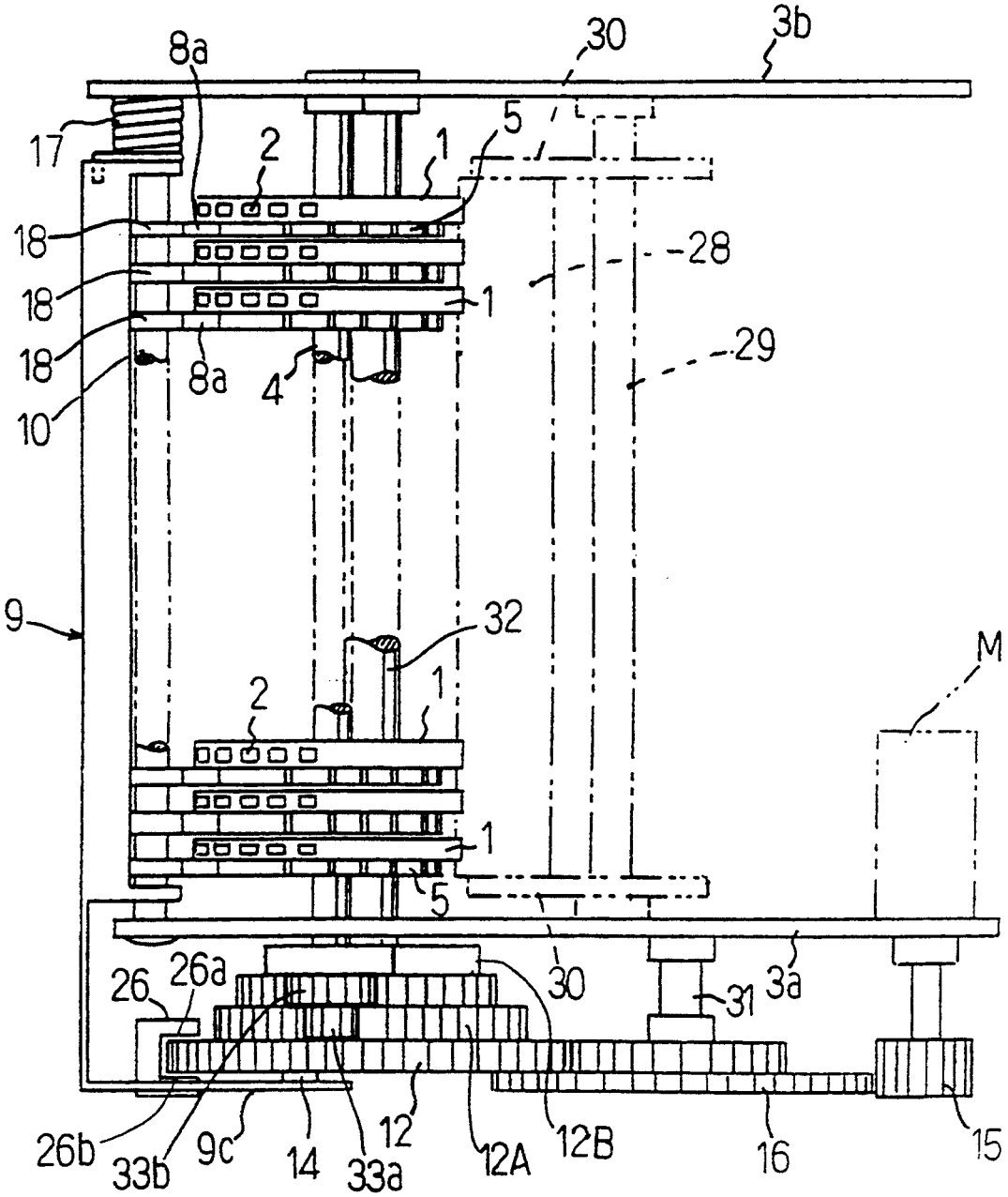
FIG. 1 is a plan view of the type-wheel resetting mechanism of the present invention for the downsized printer.

Hereinbelow, the present invention will be described in detail with reference to the accompanying drawings.

In FIGS. 1 to 8*a*, the reference numeral 1 denotes a type wheel which is provided with thirteen types 2 in its outer peripheral surface a part of which forms a non-type portion 1*a*, the types 2 comprising the numbers 0 to 9, comma, period and currency symbol such as "$" and the like.

A plurality of the type wheels 1 are provided in a type-wheel resetting mechanism of the present invention for a downsized printer. Each of the type wheels 1 is loosely fitted to a type-wheel shaft 4. The type-wheel shaft 4 is rotatably mounted in opposite side plates 3*a*, 3*b* of a base frame and rotatably driven by a motor M through a gear mechanism.

Each of the type wheels 1 is provided with a ratchet wheel 5. The ratchet wheel 5 is provided with a concave portion 6 in its central portion. Received in the concave portion 6 is an arc-shaped friction spring 7. In the concave portion 6 of the ratchet wheel 5, the friction spring 7 has its opposite ends 7*a*, 7*b* abutted resiliently against the type-wheel shaft 4 and has its arc-shaped intermediate portion abutted resiliently against a side surface of the concave portion 6. As shown in FIG. 5, the opposite ends 7*a*, 7*b* of the friction spring 7 extend radially inwardly in the concave portion 6 of the ratchet wheel 5. As is clear from the above, the friction spring 7 is brought into a frictional contact with each of the type-wheel shaft 4 and the side surface of the concave portion 6 of the ratchet wheel 5.

Consequently, each of the type wheels 1 is rotatably driven together with the type-wheel shaft 4 when its latch lever 8 (described later in detail) is not engaged with the ratchet wheel 5, and remains stationary to permit the type-wheel shaft 4 only to rotate when the latch lever 8 is engaged with the ratchet wheel 5.

The ratchet wheel 5 of each of the type wheels 1 is provided with thirteen ratchet or type teeth 5*a* and a resetting tooth 5*b* which radially outwardly extends slightly larger than any one of the ratchet teeth 5*a*.

In operation, the above-mentioned latch lever 8 is engaged with and disengaged from the ratchet wheel 5. The latch lever 8 is provided with a horizontally-elongated hole 11 in its intermediate portion. Loosely fitted to the elongated hole 11 of the latch lever 8 is a latch shaft 10 mounted between opposite end flanges 9*a*, 9*b* of a horizontally-elongated rear plate 9*a* of a latch holder 9.

Figure 2:
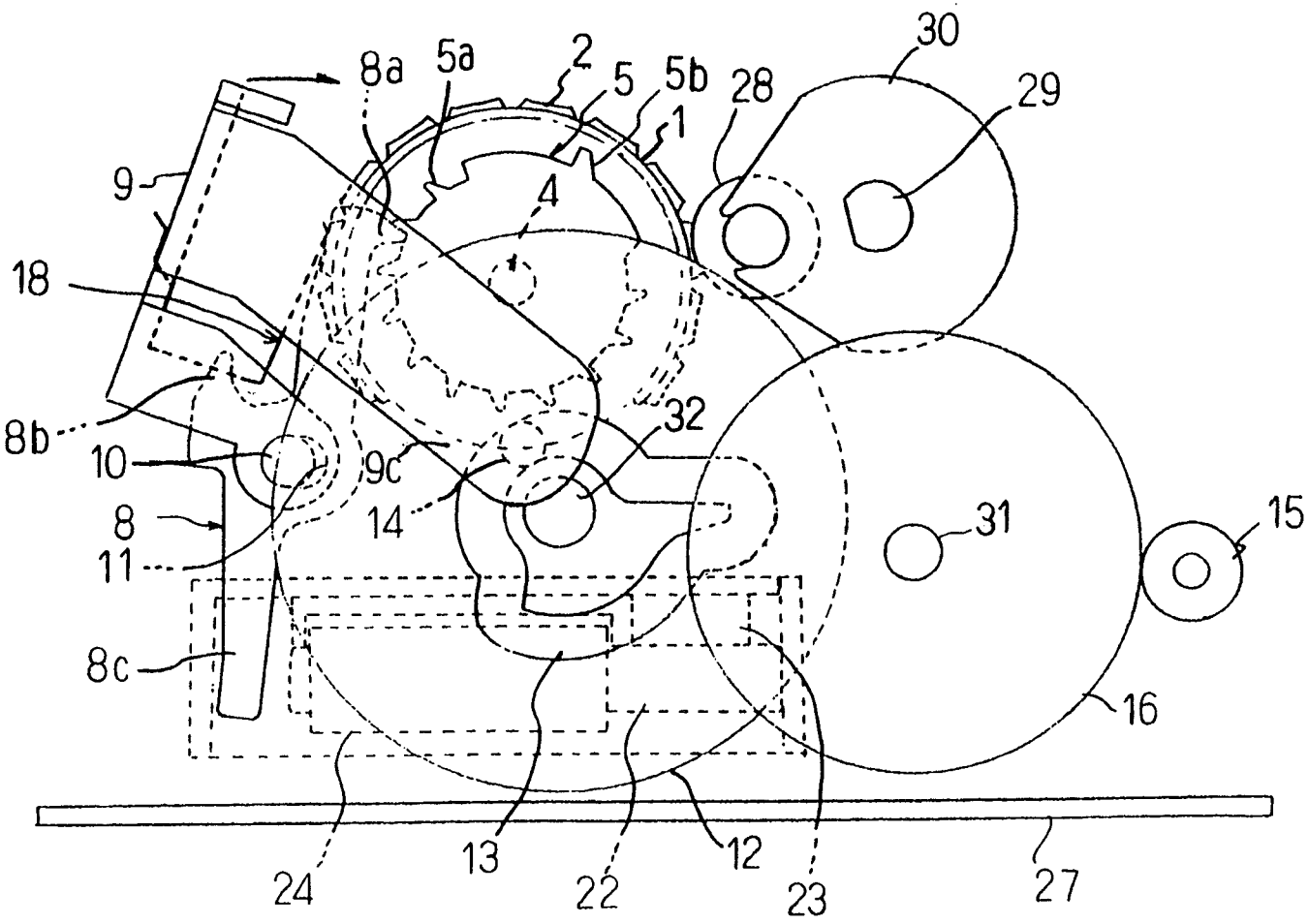
FIG. 2 is a front view of the type-wheel resetting mechanism of the present invention shown in FIG. 1.

As viewed in FIG. 2, a front-end portion (i.e., a lower-end portion when viewing FIG. 1) of the latch holder 9 is formed into a laterally-extending arm 9*c*. Provided behind this arm 9*c* is a guide pin 14 which is engaged with a cam groove 13 formed in a front surface of the drive gear 12. The latch holder 9 is biased by a suitable coil spring 17 (shown in FIG. 1) clockwise in the direction of the arrow shown in FIG. 2.

Figure 15:
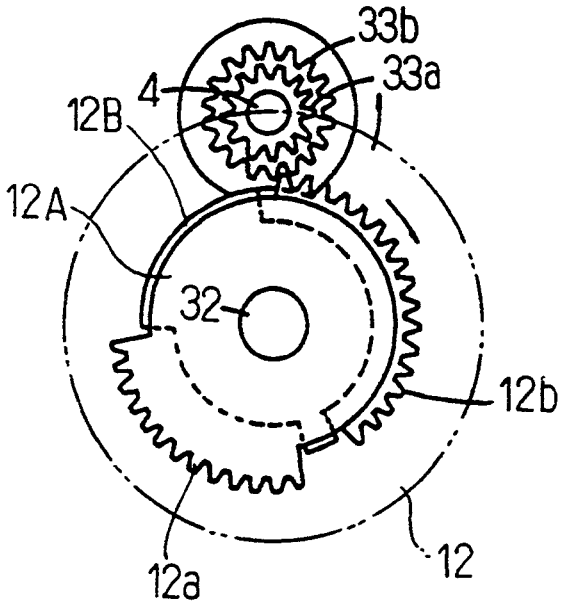
FIG. 15 is a front view of the gear mechanism of the type-wheel resetting mechanism of the present invention, in which gear mechanism the type wheel rotates two times faster than the drive gear's speed.
Figure 16:
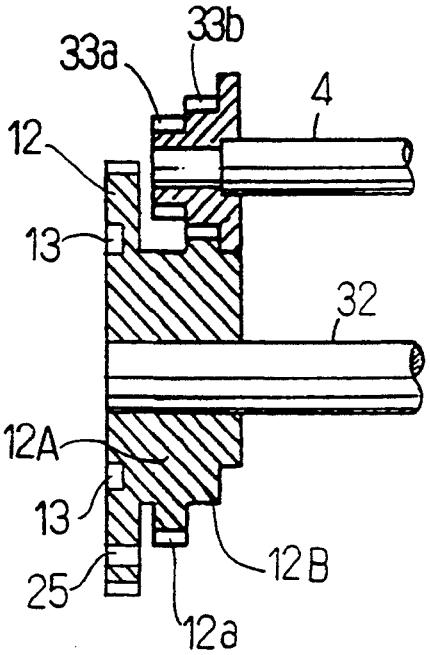
FIG. 16 is a longitudinal sectional view of the gear mechanism shown in FIG. 15.

An example of a mechanism, through which the type-wheel shaft 4 is rotatably and intermittently driven two times faster than the drive gear's (12) rotational speed, is shown in FIGS. 15 and 16.

As is clear from FIGS. 15 and 16, the drive gear 12 of this mechanism is provided with a pair of sector gears 12A and 12B which are provided with teeth 12*a* and 12*b*, respectively. A pair of driven gears 33*a*, 33*b* are fixedly mounted on the type-wheel shaft 4.

In the above gear mechanism, the teeth 12*a* of the sector gear 12A engages with the driven gear 33*a* to give a full turn to the type-wheel shaft 4, and then the teeth 12*b* of the sector gear 12B engages with the driven gear 33*b* to give an additional full turn to the type-wheel shaft 4, so that the type-wheel shaft 4 is rotatably and intermittently driven two times faster than the rotational speed of the drive gear 12.

In the above embodiment of the present invention, the drive gear 12 is driven by a motor M through a pinion 15 and a reduction gear 16. However, it is also possible to employ any other suitable gear mechanism through which the drive gear 12 may rotatably drive the type-wheel shaft 4 two times faster than its rotational speed. In the drawings: the reference numeral 31 denotes a reduction-gear shaft; and the reference numeral 32 denotes a drive shaft.

The cam groove 13 of the drive gear 12 is constructed of a series of endlessly-connected portions comprising a small-diameter portion 13*a*, an intermediate-diameter portion 13*b* and a large-diameter portion 13*c*, through which portions 13*a*, 13*b*, 13*c* the latch lever 8 is engaged with and disengaged from the type teeth 5*a* of the ratchet wheel 5.

Figure 13:
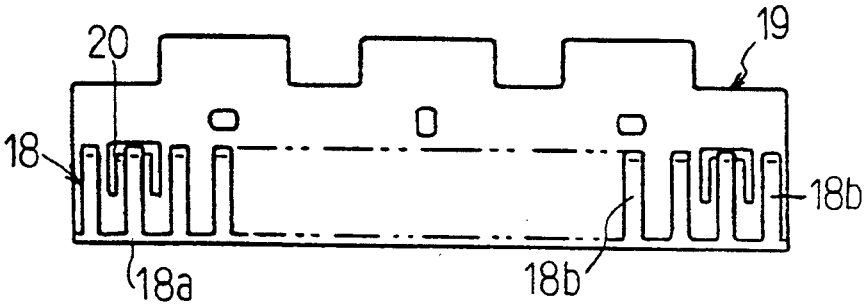
FIG. 13 is a side view of the spring plate of the type-wheel resetting mechanism of the present invention.
Figure 14:
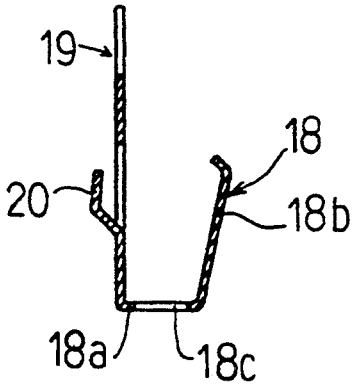
FIG. 14 is a cross-sectional view of the spring plate shown in FIG. 13.

On the latch holder 9, there is fixedly mounted a spring plate 19 (shown in FIGS. 13 and 14) which has its notch portions 20 engaged with engaging holes 21 of the latch holder 9.

Each of a plurality of leaf springs 18 is constructed of another notch portion of the spring plate 19 and has its free end brought into contact with a side edge of each of the latch levers 8.

The leaf spring 18 is provided with a horizontal portion 18*a* and an upright free-end portion 18*b* following the horizontal portion 18*a*, formed in which portion 18*a* is a horizontally-elongated hole 18*c*.

An upper portion of the latch lever 8 is formed into a pawl portion 8*a* which is engaged with and disengaged from the teeth 5*a*, 5*b* of the ratchet wheel 5. The latch lever 8 is provided with: an upright spring-engaging portion 8*b* in its intermediate portion slightly higher than the elongated hole 11 thereof; and a leg portion 8*c* in its lower-end portion.

The leg portion 8*c* of the latch lever 8 is attracted to a front end of an iron core 22 of an electromagnet 24 under the influence of a magnetic force exerted by a permanent magnet 23 provided in the iron core 22. In operation, when the electromagnet 24 is electrified, another magnetic force is produced in the iron core 22 to cancel out the magnetic force of the permanent magnet 23 so that the leg portion 8*c* of the latch lever 8 is released from the front end of an iron core 22 of an electromagnet 24.

The drive gear 12 is provided with: thirteen through-holes 25 which serve as detected portions corresponding to the thirteen type teeth 5*a* of the ratchet wheel 5 integrally formed with the type wheel 1; and, an additional through-hole 25*a* which serves as an additional detected portion for cutting off an electric current supplied to the motor M. Each of these through-holes 25, 25*a* of the drive gear 12 is formed in a position on the same coaxial circle of of the drive gear 12.

These through-holes 25, 25*a* are detected by a photo-coupler 26. The photo-coupler 26 is fixedly mounted on a base plate 27 to serve as a sensor. As is clear from FIG. 1, a light-emitting portion 26*a* and a light-receiving portion 26*b* of the photo-coupler 26 are so arranged as to sandwich a peripheral portion of the drive gear 12 therebetween.

When the photo-coupler 26 detects the light passing through any one of the through-holes 25, 25*a* of the drive gear 12, the photo-coupler 26 issues a detection signal to a suitable control circuit (not shown). For example, when the photo-coupler 26 detects any one of the through-holes 25 corresponding to the types being printed, the above control circuit issues a printing instruction to electrify the electromagnet 24, so that the latch lever 8 is engaged with a corresponding one of the type teeth 5*a* of the ratchet wheel 5. On the other hand, when the photo-coupler 26 detects the additional through-hole 25*a* of the drive gear 12, the above-mentioned control circuit (not shown) issues a motor-stopping instruction to cut off the electric current supplied to the motor M so that the motor M stops rotating.

Incidentally, in the drawings, the reference numeral 28 denotes a platen roller an axle 29 of which has its opposite ends mounted rotatably in a pair of bearing elements 30. In operation, when the type 2 of the type wheel 1 to be printed is selected, the axle 29 of the platen roller 28 is rotatably driven and pressed against the type wheel 1 according to the printing instruction so that the type 2 of the type wheel 1 is printed on a paper.

The above printing mechanism is conventional, and, therefore not described herein in detail to avoid redundancy in description.

Now, the present invention will be described in operation.

Figure 3A:
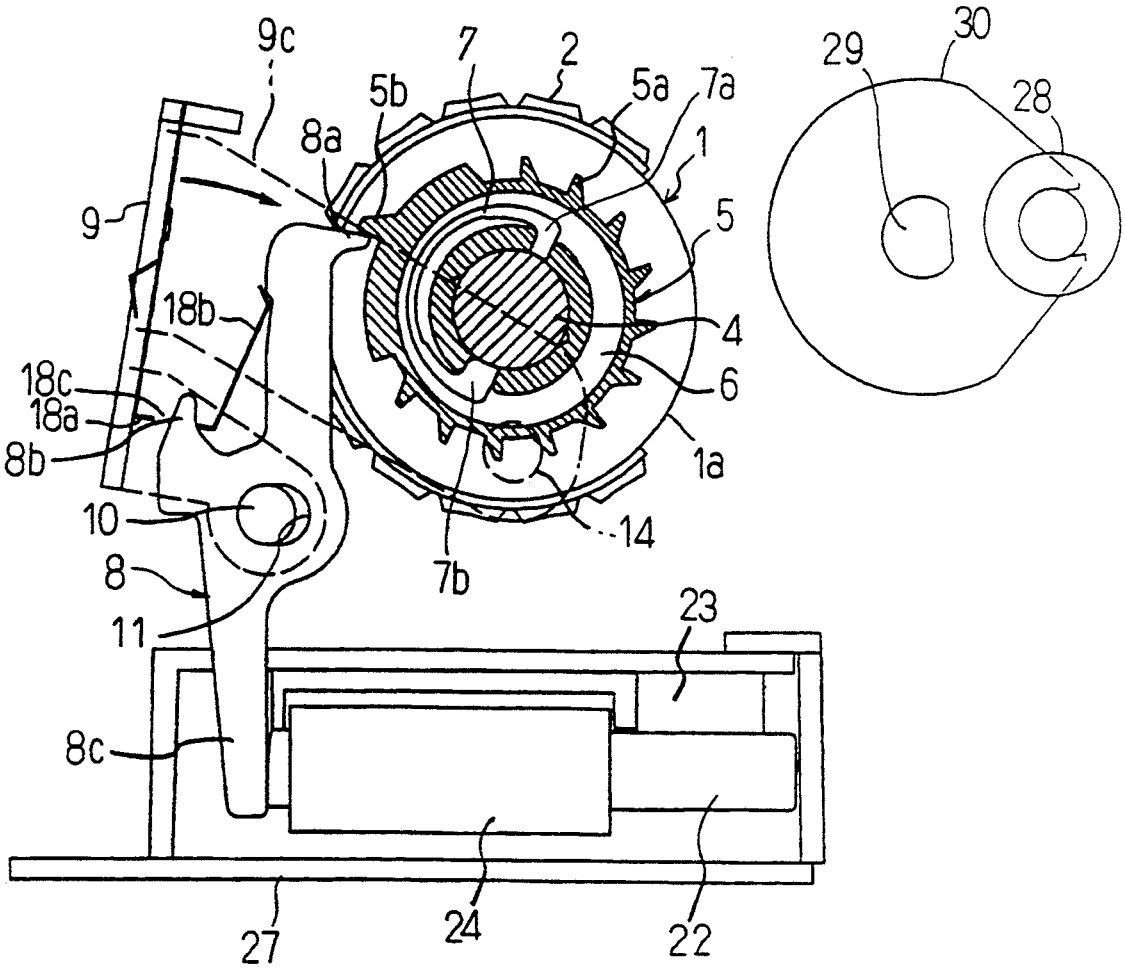
FIG. 3*a* is a view substantially similar to FIG. 2, but illustrating a condition in which the type-wheel resetting mechanism of the present invention is alerted.
Figure 3B:
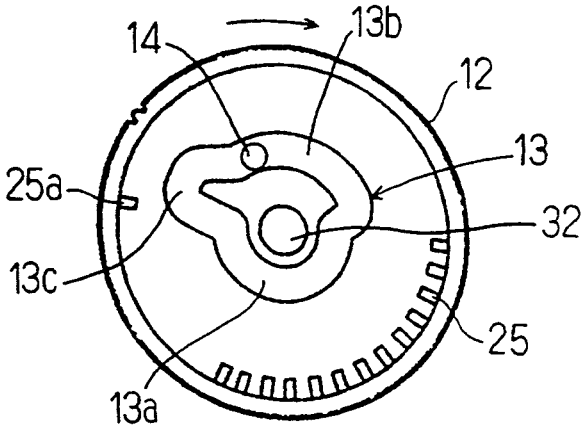
FIG. 3*b* is a front view of the position of the guide pin relating to the rotational position of cam groove in a condition shown in FIG. 3*a*.

FIGS. 3*a* and 3*b* show a condition in which the latch lever 8 is standing by ready to operate.

In this condition, the guide pin 14 provided in the arm 9*c* of the latch holder 9 is engaged with the intermediate-diameter portion 13*b* of the cam groove 13 of the drive gear 12 as shown in FIG. 3*b*, while the pawl portion 8*a* of the latch lever 8 is engaged with the resetting tooth 5*b* of the ratchet wheel 1 and disposed in a position radially outer than any one of the type teeth 5*a* of the ratchet wheel 5 with regard to a center of the type-wheel shaft 4.

Figure 4A:
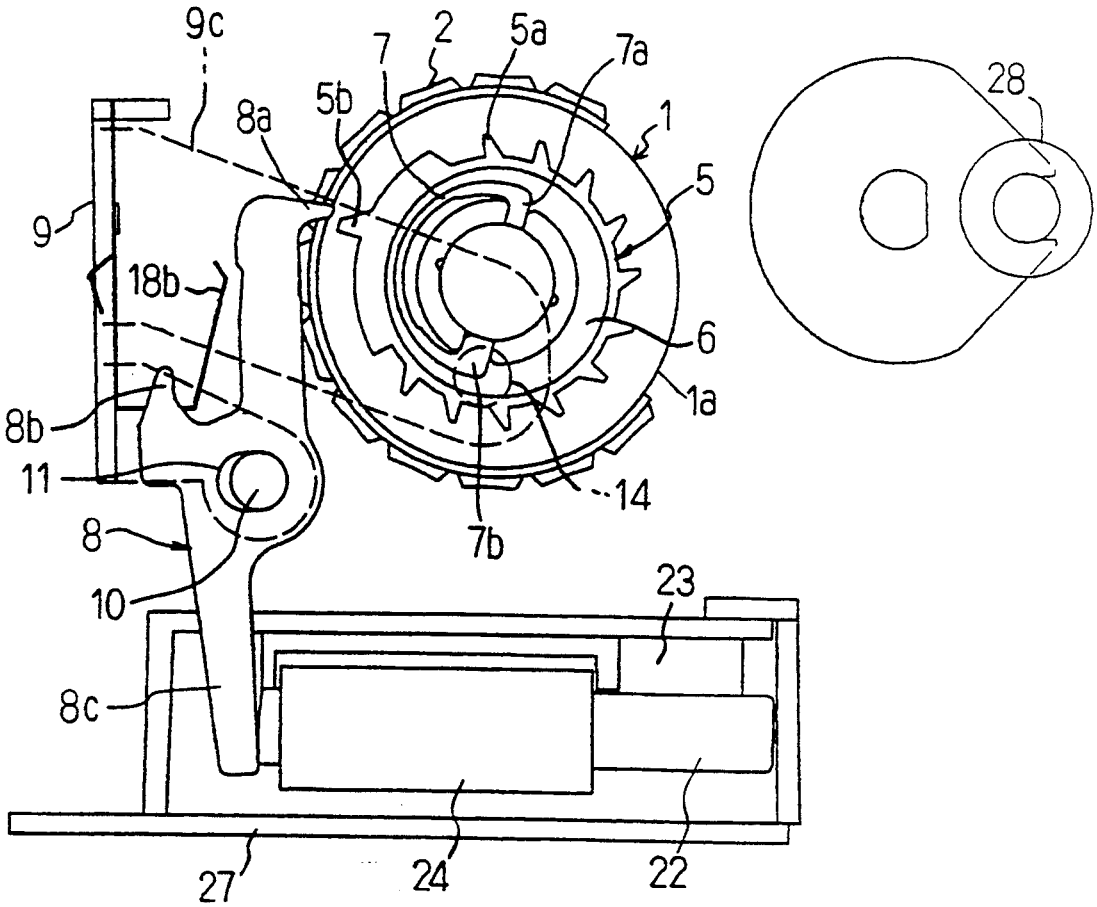
FIG. 4*a* is a view substantially similar to FIG. 2, but illustrating a condition in which the type-wheel resetting mechanism of the present invention starts its type selective picking-up operation.
Figure 4B:
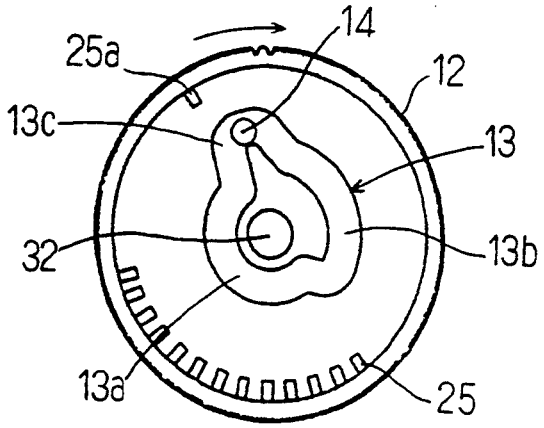
FIG. 4*b* is a front view of the position of the guide pin relating to the rotational position of cam groove in a condition shown in FIG. 4*a;*

FIGS. 4*a* and 4*b* show a condition in which the type-wheel resetting mechanism of the present invention starts its type selective picking-up operation.

Namely, when the operation starting instruction is issued, the motor M starts rotating to rotatably drive the drive gear 12.

In operation, when the large-diameter portion 13*c* of the cam groove 13 of the drive gear 12 reaches the guide pin 14 of the arm 9*c* of the latch holder 9 in operation, the latch holder 9 is swingably moved toward the left by the large-diameter portion 13*c* of the cam groove 13 as viewed in FIG. 4*a*, so that latch lever 8 is rotated counterclockwise by the horizontally-elongated hole 18*c* of the leaf spring 18, whereby the pawl portion 8*a* of the latch lever 8 is disengaged from the resetting tooth 5*b* of the ratchet wheel 5 of the type wheel 1.

Figure 5A:
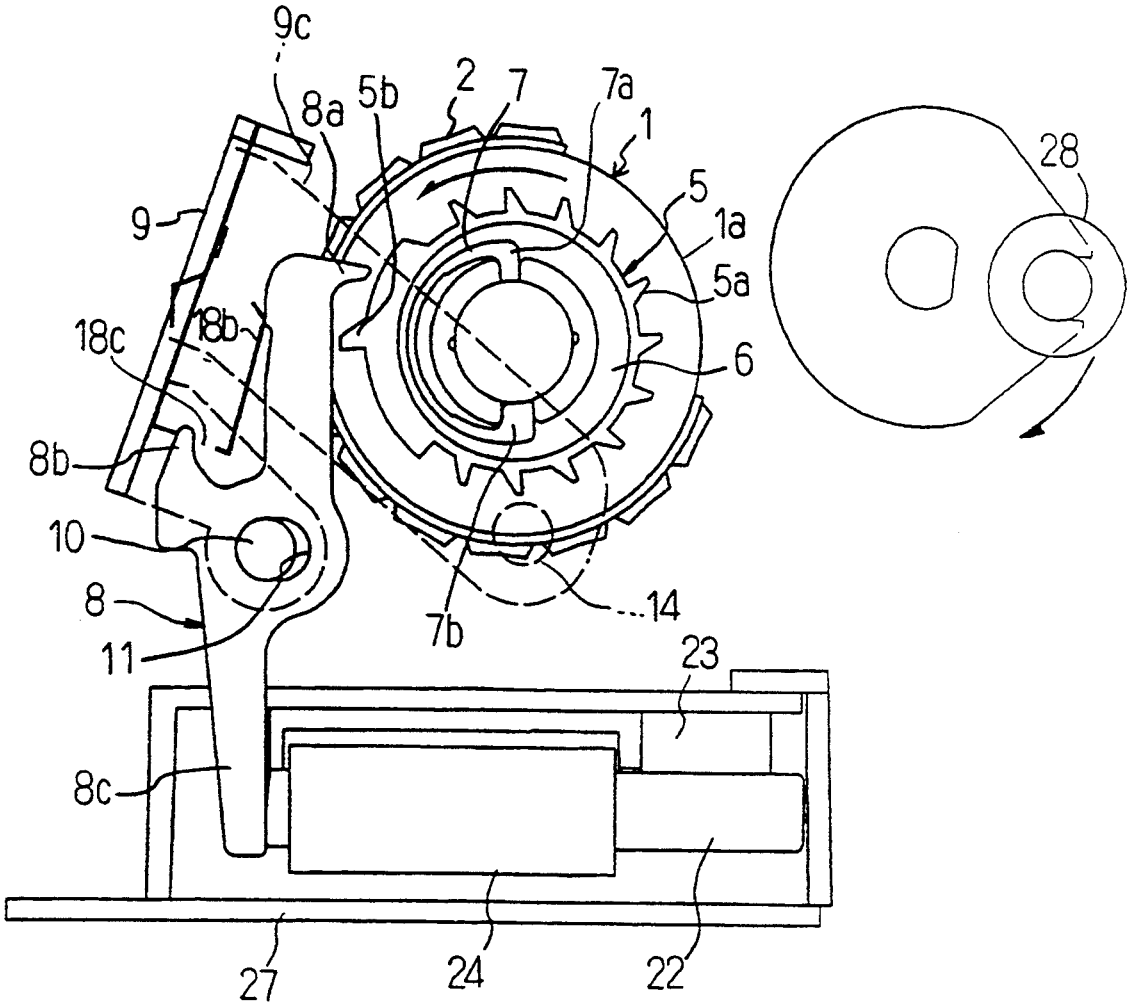
FIG. 5*a* is a view substantially similar to FIG. 2, but illustrating a condition in which the type-wheel resetting mechanism of the present invention is ready for performing the picking-up operation.
Figure 5B:
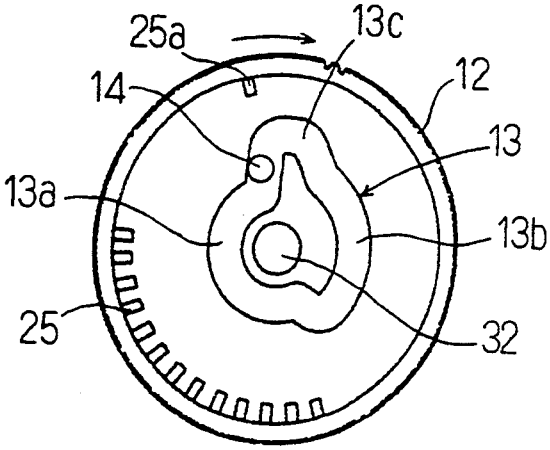
FIG. 5*b* is a front view of the position of the guide pin relating to the rotational position of cam groove in a condition shown in FIG. 5*a;*
Figure 6A:
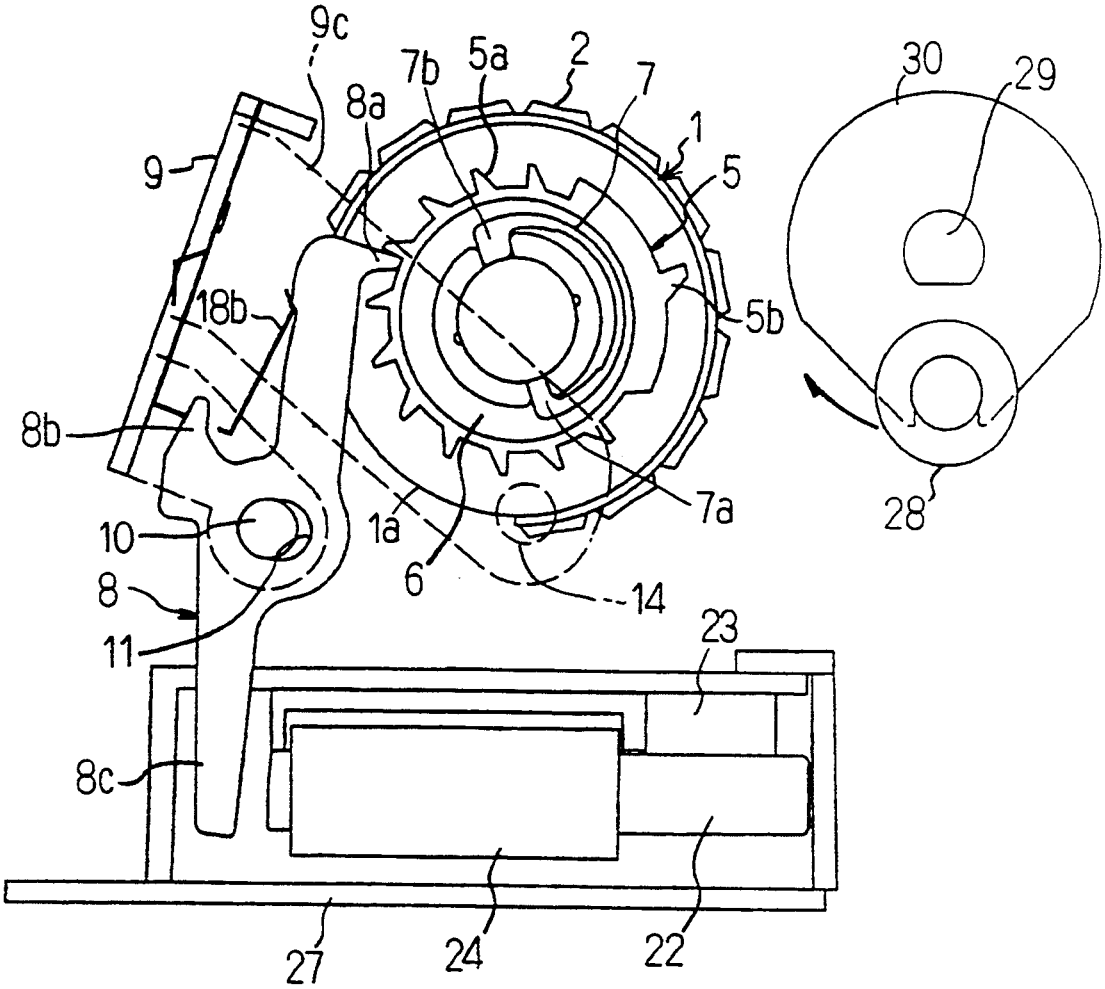
FIG. 6*a* is a view substantially similar to FIG. 2, but illustrating a condition in which the type-wheel resetting mechanism of the present invention has performed the picking-up operation.
Figure 6B:
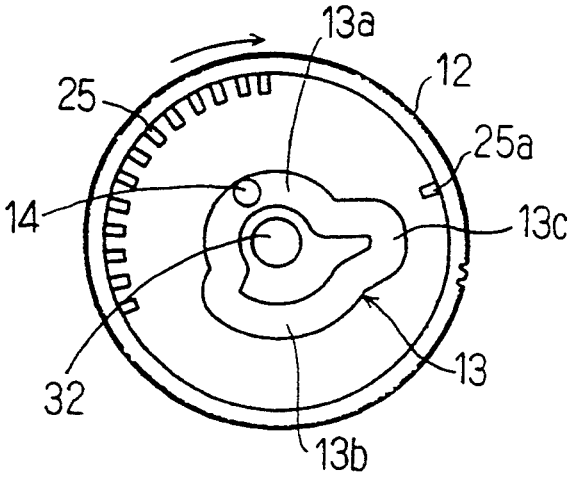
FIG. 6*b* is a front view of the position of the guide pin relating to the rotational position of cam groove in a condition shown in FIG. 6*a;*
Figure 7A:
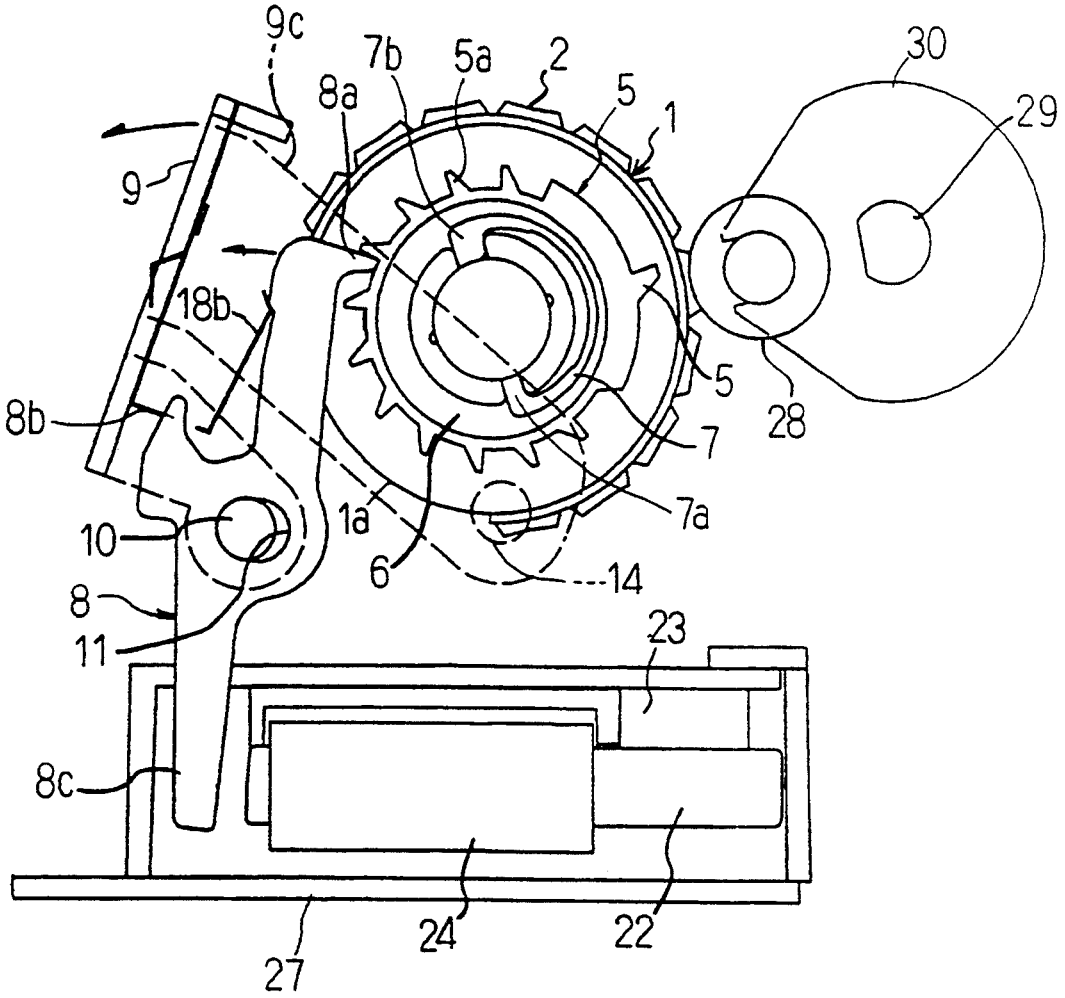
FIG. 7*a* is a view substantially similar to FIG. 2, but illustrating a printing operation performed by the type-wheel resetting mechanism of the present invention.
Figure 7B:
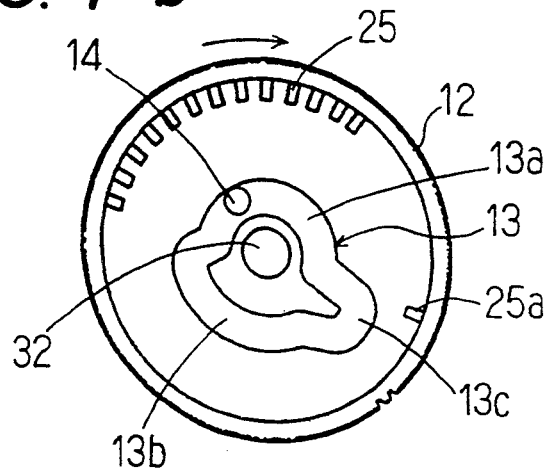
FIG. 7*b* is a front view of the position of the guide pin relating to the rotational position of cam groove in a condition shown in FIG. 7*a;*

On the other hand, when the small-diameter portion 13*a* of the cam groove 13 of the drive gear 12 reaches the guide pin 14 of the arm 9*c* of the latch holder 9 in operation as shown in FIG. 5*b*, the latch holder 9 is swingably moved to the right as viewed in FIG. 5*a* so that the latch lever 8 is moved toward the right under the influence of a resilient force exerted by the upright free-end portion 18*b* of the leaf spring 18 to have a left-side inner surface of its elongated hole 11 abut against the latch shaft 10.

Under such circumstances, as is clear from FIG. 5*a*, the pawl portion 8*a* of the latch lever 8 is disposed in a position radially outer than any one of the type teeth 5*a* of the ratchet wheel 5 as to the center of the type-wheel shaft 4 to permit the type wheel 1 to rotate counterclockwise together with the type-wheel shaft 4, which makes it possible to select a desired one of the types 2 being printed.

In operation, when a desired one of the type teeth 5*a* (which corresponds to the desired one of the type wheel's types 2 to be printed) reaches the pawl portion 8*a* of the latch lever 8, the drive gear's through-hole 25 (which serves as the detected portion for selecting the types 2 and corresponds to the desired one of the types 2 to be printed) is detected by the photo-coupler 26 so that the desired one of the types 2 to be printed is indirectly detected, whereby a detection signal is issued from the photo-coupler 26 to the the control circuit (not shown) which issues in turn a signal to have the electromagnet 24 electrified with a pulse current.

The electromagnet 24 has the magnetic force of its iron core 22 canceled out when electrified. As a result, the latch lever 8 is rotated counterclockwise as viewed in FIG. 6*a* under the influence of the resilient force exerted by the free-end portion 18*b* of the leaf spring 18, so that the pawl portion 8*a* of the latch lever 8 is engaged with the desired one of the type teeth 5*a* of the ratchet wheel 5. After that, the type wheel 1 stops rotating to complete the type selection operation for selecting the desired one of the types 2 being printed.

In operation, as shown in FIG. *7a*, after the type wheel 1 stops rotating, the platen roller 28 is so operated as to firmly sandwich a paper (not shown) between the type wheel 1 and the platen roller 28, whereby the printing operation of the desired one of the types 2 onto the paper is performed.

Figure 8A:
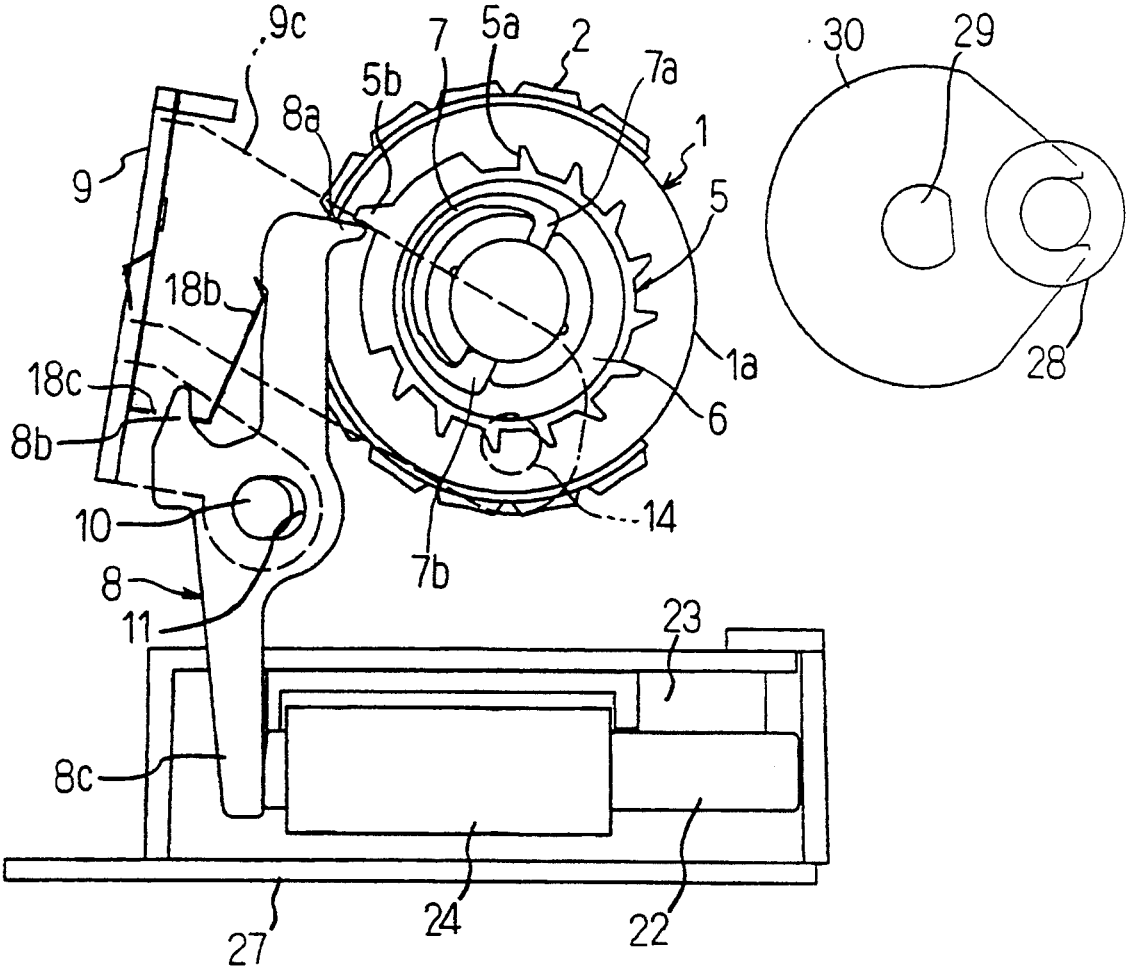
FIG. 8*a* is a view substantially similar to FIG. 2, but illustrating a return stroke of the type wheel of the type-wheel resetting mechanism of the present invention.
Figure 8B:
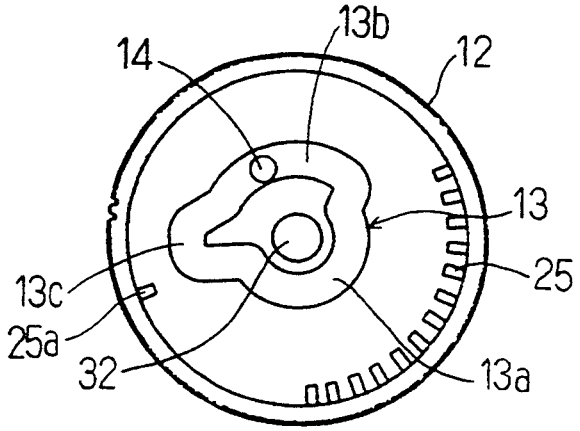
FIG. 8*b* is a front view of the position of the guide pin relating to the rotational position of cam groove in a condition shown in FIG. 8*a;*
Figure 9:
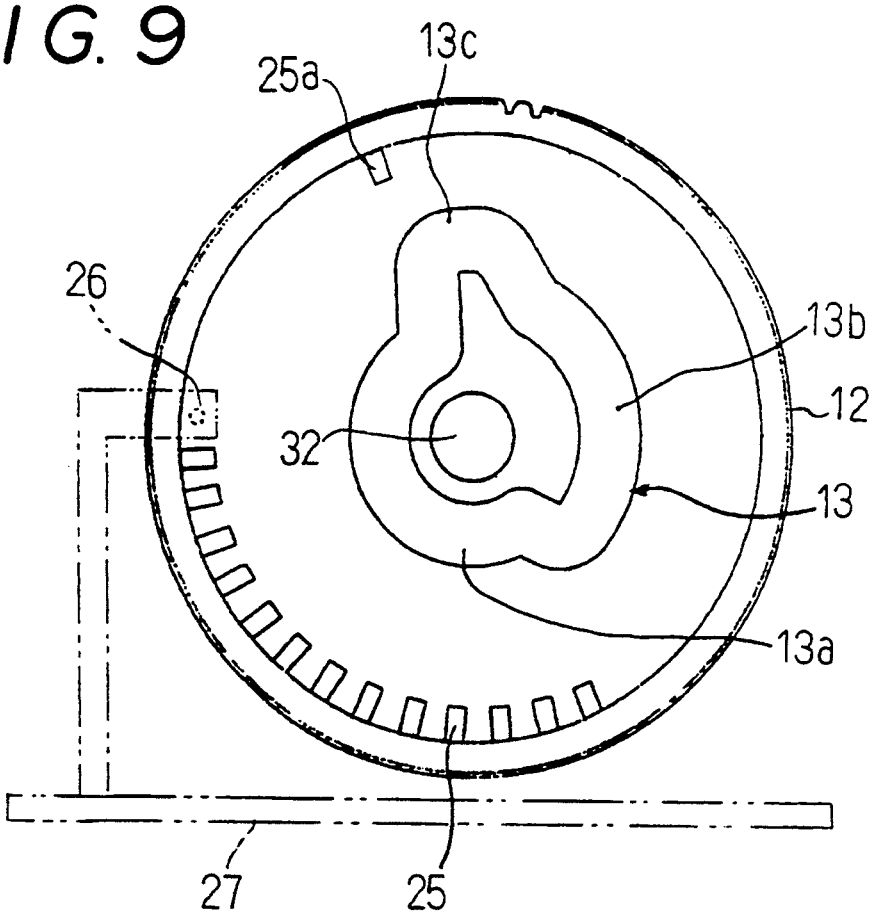
FIG. 9 is a front view of the drive gear of the type-wheel resetting mechanism of the present invention.
Figure 10:
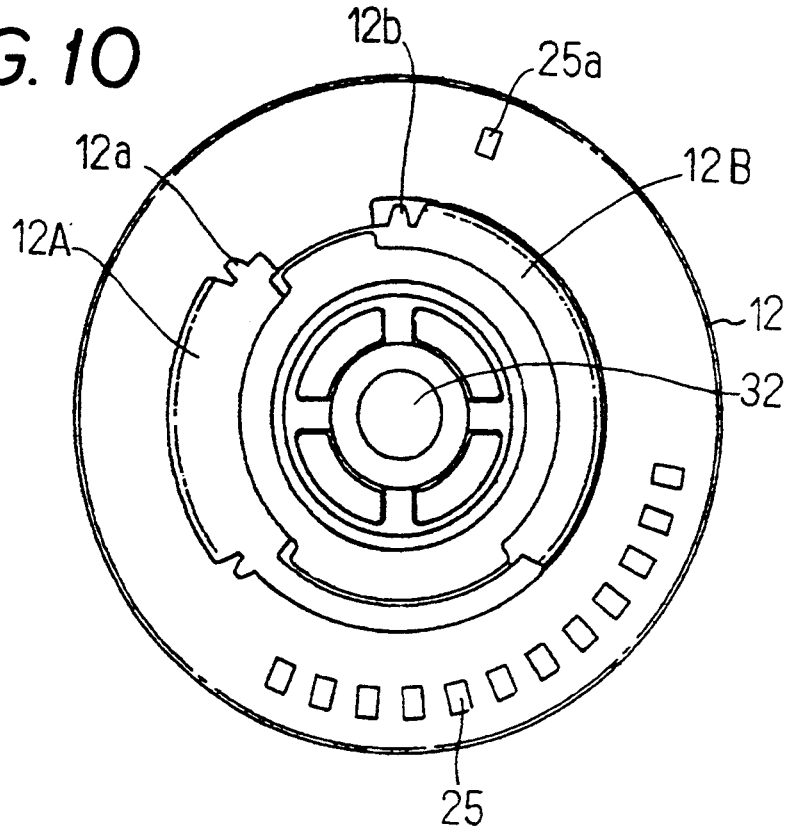
FIG. 10 is a rear view of the drive gear shown in FIG. 9.
Figure 11:
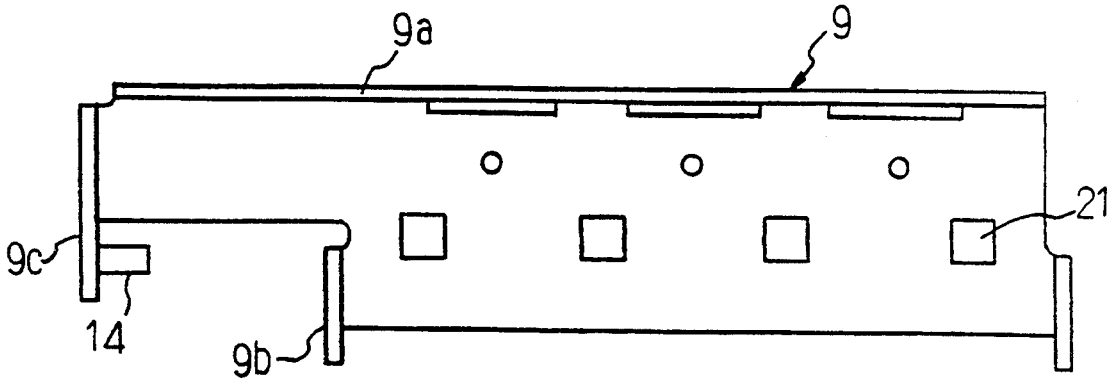
FIG. 11 is a side view of the latch holder of the type-wheel resetting mechanism of the present invention.
Figure 12:
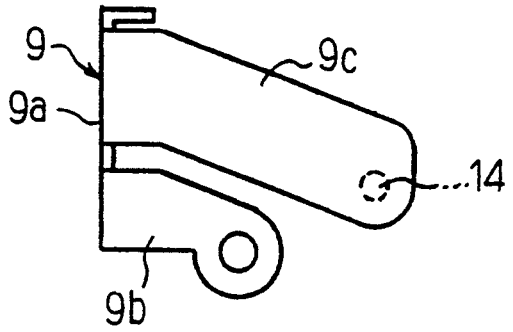
FIG. 12 is a front view of the latch holder shown in FIG. 11.

After the printing operation is completed, the electromagnet is de-energized to attract the leg portion 8*c* of the latch lever 8. At this time, the intermediate-diameter portion 13*b* of the cam groove 13 of the drive gear 12 reaches the guide pin 14 of the arm 9*c* of the latch holder 9 as shown in FIG. 8*b* to have the holder 9 to swingably move toward the left, whereby the pawl portion 8*c* of the latch lever 8 is disengaged from the desired one of the type teeth 5*a* of the ratchet wheel 5 after the desired one of the types 2 has been printed.

As a result, the type wheel 1 is rotatably driven together with the type-wheel shaft 4 until the resetting tooth 5*b* of the ratchet wheel 5 engages with the pawl portion 8*a* of the latch lever 8. When the resetting tooth 5*b* of the ratchet wheel 5 engages with the pawl portion 8*a* of the latch lever 8, the type wheel 1 stops rotating so as to be reset to return its initial state.

Even in this state, the drive gear 12 is still rotatably driven by the motor M. When the motor-stopping through-hole 25*a* of the drive gear 12 reaches the photo-coupler 26 and is detected thereby, the photo-coupler 26 issues the detection signal to the control circuit (not shown) which in turn issues a de-energizing signal to cut off the supply of electricity to the motor M, so that the motor M stops rotating to stop the rotational motion of the drive gear 12.

As described above, according to the present invention, since the type-wheel resetting mechanism of the present invention employs the spring mechanism, it is possible to simplify the type-wheel resetting mechanism of the present invention in construction.

Further, in the type-wheel resetting mechanism of the present invention, since the resetting cam portion is provided in the drive gear 12, it is possible to save a large number of components and eliminate the assembly and adjusting operations of the cam component and the drive gear 12.

Furthermore, in the type-wheel resetting mechanism of the present invention, since the detected portions for performing the type selection and motor-stopping operations are provided in the drive gear 12 and the sensor for detecting such detected portions is provided in the vicinity of the drive gear 12, it is possible to further save the number of necessary components and improve the type-wheel resetting mechanism of the present invention in reliability.

What is claimed is:

1. A type-wheel resetting mechanism for a downsized printer, comprising:

(a) a type wheel provided with a plurality of types in its outer peripheral surface, said type wheel being also provided with a ratchet wheel in its side surface, said ratchet wheel being provided with a plurality of ratchet teeth and a resetting tooth which radially outwardly extends slightly larger than any one of said ratchet teeth, a function spring, a type-wheel shaft, said type wheel being rotatably mounted on said type-wheel shaft while rotatably driven together with said type-wheel shaft under the influence of said friction spring, (b) a drive gear provided with a cam portion in its side surface, said cam portion being constructed of a series of portions comprising a small-diameter portion, an intermediate-diameter portion and a large-diameter portion adapted to perform a start-up operation, means for rotatably coupling said drive gear to said type wheel such that said type wheel is driven at twice the rotational speed of the drive gear;

(c) a latch holder provided with a pair of bearing flanges in its opposite ends, a latch shaft loosely fitted to said pair of bearing flanges, a spring, said latch holder being urged by said spring in a direction toward said type wheel, said latch holder having first and second ends, said latch holder being also provided with a guide pin in said first end to have said guide pin engaged with said cam portion of said drive, (d) a latch lever provided with an elongated hole to which said latch shaft is loosely fitted, said latch lever being further provided with leg portion and a pawl portion in its upper portion to have said pawl portion engaged with and disengaged from said ratchet wheel, (e) an electromagnet which attracts said leg portion of said latch lever when de-energized, and loses its attractive force when energized, (f) a spring plate mounted on said latch holder and including a notch portion, (g) a leaf spring integrally formed with said notch portion of said spring plate, (h) a plurality of detected portions provided in said drive gear, said detected portions being adapted for type selection and motor stop operations, through which type selection operation said types of said type wheel corresponding to said ratchet teeth of the same are detected;

(i) a control circuit, and (j) a sensor for detecting said detected portion to issue a signal to said control circuit so as to have said control circuit issue a printing instruction and a motor stopping instruction.

2. The type-wheel resetting mechanism for the downsized printer, as set forth in claim 1, wherein:

each of said detected portions of said drive gear is constructed of a through-hole formed in a position on the same coaxial circle of said drive gear; and said sensor is constructed of a photo-coupler for detecting a light beam passing through said through-hole of said drive gear.

* * * * *